US005335794A

United States Patent [19]

Reedy

[11] Patent Number: 5,335,794

[45] Date of Patent: Aug. 9, 1994

[54] SPORTS EQUIPMENT SUPPORT RACK

[75] Inventor: Michael H. Reedy, Edwardsville, Ill.

[73] Assignee: Lee Rowan Company, St. Louis, Mo.

[21] Appl. No.: 7,117

[22] Filed: Jan. 21, 1993

[51] Int. Cl.[5] ..... A47F 7/00

[52] U.S. Cl. ..... 211/13; 211/106

[58] Field of Search ..... 211/13, 14, 106, 181

[56] References Cited

U.S. PATENT DOCUMENTS

| | | | |
|---|---|---|---|
| 4,002,241 | 1/1977 | Parilla, Sr. | 211/14 X |
| 4,561,547 | 12/1985 | Estwanik, III | 211/14 |
| 4,854,456 | 8/1989 | Lee | 211/14 |
| 4,936,467 | 6/1990 | Bobeczko | 211/14 |
| 5,199,581 | 4/1993 | Arnold | 211/106 |
| 5,203,462 | 4/1993 | Brooks | 211/14 |
| 5,209,359 | 5/1993 | Arnold | 211/106 |

*Primary Examiner*—Alvin C. Chin-Shue

*Assistant Examiner*—Sarah A. Lechok

*Attorney, Agent, or Firm*—Rogers, Howell & Haferkamp

[57] ABSTRACT

A sports equipment support rack is a combination of a fixed main frame, a basket, and a hoop and hook assembly. The fixed frame includes bat retainers for supporting a plurality of bats, and parallel guide members for removably supporting such similarly sized balls as basketballs, soccer balls, volleyballs, and the like. The fixed frame also includes opposite pairs of retaining hooks on the opposite lateral sides of the fixed frame. The retaining hooks releasably retain either the basket or the hoop and hook assembly interchangeably. The basket provides storage for articles of sports equipment including smaller sized balls like footballs or baseballs. The hoop and hook assembly includes a horizontal hoop providing a ring surface portion upon which a ball like a basketball can be removably supported.

17 Claims, 2 Drawing Sheets

SPORTS EQUIPMENT SUPPORT RACK

BACKGROUND AND SUMMARY OF THE INVENTION

The present invention relates to support racks, and more particularly to support racks that mount to a wall and provide removable support for sports equipment.

Sports equipment storage racks are known in the art. A representative known storage rack, shown in U.S. Pat. No. 4,643,317, is particularly adapted for supporting tennis rackets and other accessories of the game of tennis. That representative known storage rack is a combination of a fixed frame and a basket, the fixed frame being attachable to a wall and removably supporting the basket. The fixed frame includes a mounting plate, the mounting plate supports a plurality of forwardly projecting horizontal segments, and two pairs of the horizontal segments define two tennis racket hooks while a single horizontal segment defines a basket hook. The basket includes a long handle extending up from the basket bottom, the handle has a grip, and the grip has a hole for removably receiving the basket hook.

The sports equipment support rack of the present invention is an improvement over the sports equipment storage racks of the prior art. This sports equipment storage rack has both a fixed frame and a removable basket which provide removable support for the equipment of a greater variety of sports. Thus, athletes who enjoy multiple sports can store their multi-sport equipment on just this one rack. In contrast, since the prior art storage racks typically are specially adapted for a single sport, those same athletes would need multiple prior art racks at a greater expense and inconvenience. For households with several athletes who have different sporting interests, their collective needs for a support rack can be met by this rack of the present invention.

Another advantage of this support rack is that it includes a removable hoop and hook assembly. The hoop and hook assembly is selectively formed to have a horizontal ring portion for removably supporting a ball such as a basketball, soccer ball, volleyball, or the like. The hoop and hook assembly further includes protruding hooks from which articles can be hung. The hoop and hook assembly is optionally removable and interchangeable with the basket.

Another advantage of this support rack is that the fixed frame has two sets of basket retaining hooks. Normally, one set is used for retaining the basket while the other set is used for retaining the hoop and hook assembly. However, the two sets may be optionally used for retaining two baskets and no hoop and hook assemblies, or two hoop and hook assemblies and no baskets.

In addition, the fixed frame, the basket, and the hoop and hook assembly are each made of metal wire elements held in position by welded joints. The individual wire elements are formed in configurations providing gains in manufacturing simplicity and efficiency. As a combination, the components of the sports equipment support rack are strong yet inexpensive to fabricate. For gaining reduced shipping costs, the sports equipment support rack is lightweight and the basket is nestable with like baskets. These and more advantages are provided by the present invention without sacrificing appearance or durability.

In accordance with the present invention, the sports equipment support rack is a combination of a fixed frame, a removable basket, and a removable hoop and hook assembly. The frame, the basket, and the hoop and hook assembly each are assemblies of selectively formed metal wires held in position by welded joints and coated in enamel.

The fixed frame is attachable to a wall and includes two C-shaped brackets laterally spaced from one another. The two C-shaped brackets have vertical rear segments anchored relative to the wall and forwardly projecting upper and lower horizontal segments. The lower horizontal segments are grouped in pairs to define slots that open forwardly. The slots enable the removable and upright support of a plurality of baseball bats because the lower horizontal segments are disposed on either side of the slot and so can underlie the knobs of the bat handles.

The spaced upper segments of the C-shaped brackets support a parallel pair of laterally extending guide segments. The guide segments have horizontal central portions providing spaced elongated surfaces for removably supporting a plurality of balls such as basketballs, soccer balls, volleyballs, and the like. The laterally spaced upper segments act as ball retainers and retain the removably supported balls therebetween. The guide segments have outer tip portions bent upwardly to form a pair of retaining hooks oppositely disposed on both lateral sides of the fixed frame. The retaining hooks are provided for releasably retaining either the basket or the hoop and hook assembly on either lateral side of the fixed frame interchangeably.

The basket is made from two sets of U-shaped wires with their respective horizontal segments fixed in a criss-cross pattern to define a grid basket bottom. The basket further includes a wire hoop extending across all of the outer ends of the U-shaped wires and welded to them to fix all those outer ends in rigid relative positions. The upper arms of the U-shaped wires define a front, a back, and two opposite side walls for the basket; and these four side walls are inclined to taper down so that the basket is nestable with other like baskets. The retaining hooks of the fixed frame act to releasably retain the basket by hooking the hoop element.

The hoop and hook assembly has a main wire that includes a middle portion forming a horizontal hoop, and outer portions bent downwardly to form L-shaped hooks. There is also a horizontal brace wire extending across and welded to the vertical stems of the L-shaped hooks. The fixed frame releasably retains the hoop and hook assembly by the action of the retaining hooks hooking the brace wire. The middle hoop portion of the main wire provides a horizontal ring portion for removably supporting a ball such as a basketball, soccer ball, volleyball, or the like.

BRIEF DESCRIPTION OF THE DRAWINGS

Further objects and features of the present invention are revealed in the following detailed description of the preferred embodiment of the invention and in the drawing firers wherein.

DESCRIPTION OF THE PREFERRED EMBODIMENT

Figures 1, 2:
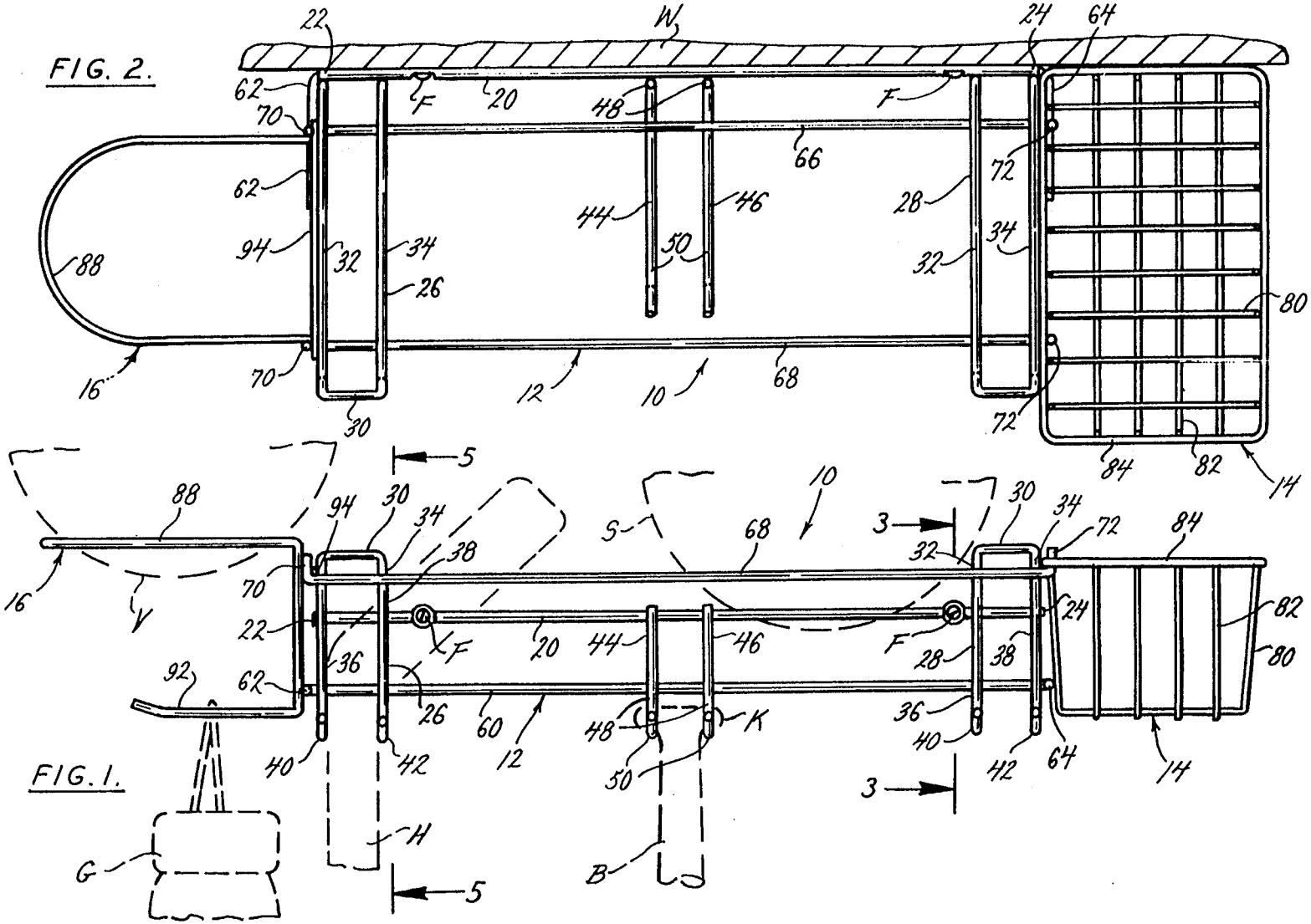
FIG. 1 is a front elevation view of the sports equipment support rack of the present invention, with various articles of sports equipment shown in broken lines to illustrate the support thereof.
FIG. 2 is a top plan view of the support rack.
Figure 3:
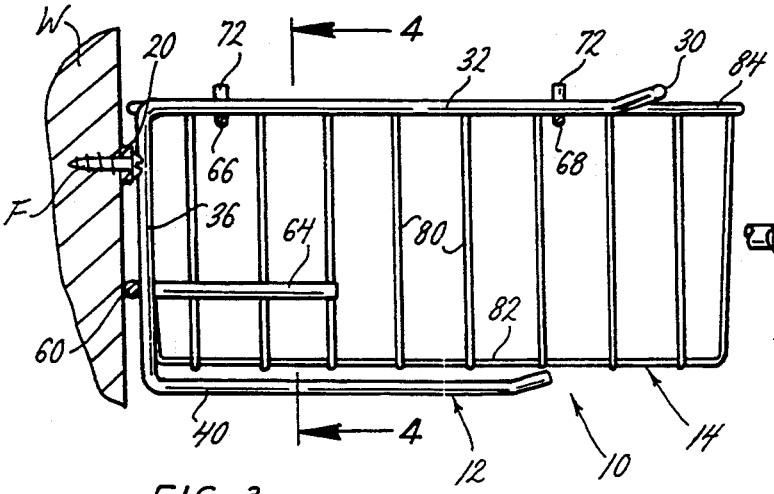
FIG. 3 is an enlarged section view taken along the line 3—3 of FIG. 1.
Figure 4:
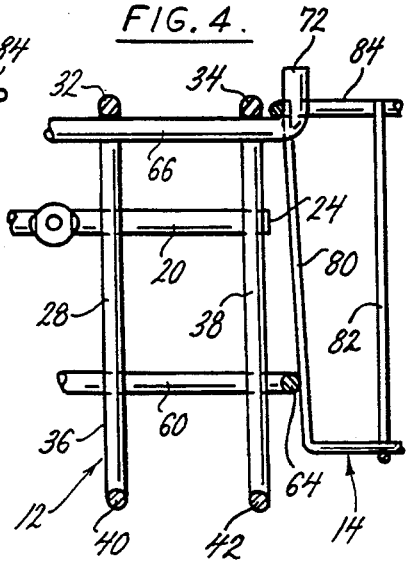
FIG. 4 is an enlarged section view partly broken away taken along the line 4—4 of FIG. 3.
Figure 5:
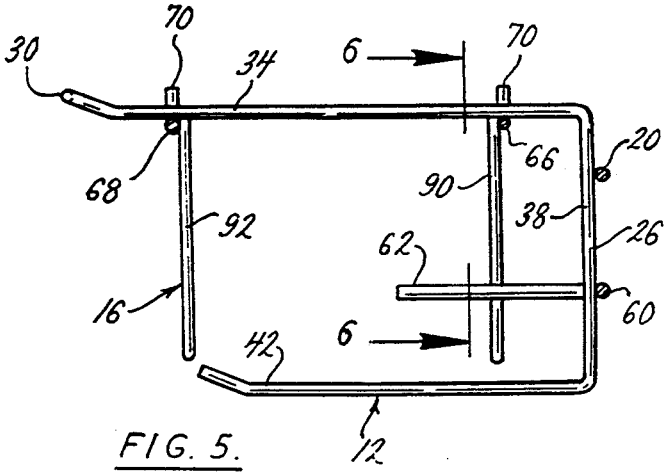
FIG. 5 is an enlarged section view taken along the line 5—5 of FIG. 1.
Figure 6:
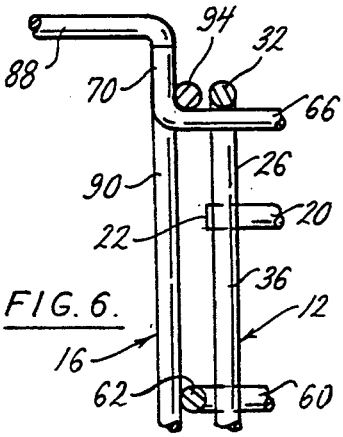
FIG. 6 is an enlarged section view partly broken away taken along the line 6—6 of FIG. 5.

The Figures show the sports equipment support rack 10 of the present invention to comprise a wire main frame 12, a removable wire basket 14, and a removable hoop and hook assembly 16 of wire.

The main frame 12 includes a horizontal mounting wire 20 supported in place on a wall W by means of fasteners F. The mounting wire 20 has opposite ends 22 and 24, and adjacent each opposite end 22 and 24 the mounting wire 20 supports a C-shaped wire bracket 26 and 28 by means of welded joints. Each C-shaped bracket 26 and 28 includes a centrally disposed cross-segment 30, parallel upper segments 32 and 34, parallel rear segments 36 and 38, and parallel lower segments 40 and 42. The mounting wire 20 also has a middle portion from which it supports an identical pair of L-shaped brackets 44 and 46 by means of welded joints. Each L-shaped bracket 44 and 46 has a vertical segment 48 and a horizontal segment 50.

Below and generally parallel to the mounting wire 20, there is a horizontal bracing wire 60 that has opposite outer portions 62 and 64 bent forwardly. The main frame 12 gains rigidity and strength from the bracing wire 60 extending across and being welded to all rear segments 36 and 38 of the C-shaped brackets 26 and 28 and both vertical segments 48 of the L-shaped brackets 44 and 46.

The upper segments 32 and 34 of the C-shaped brackets 26 and 28 support a pair of parallel guide members 66 and 68 by means of welded joints. Each guide member 66 and 68 has a central portion extending laterally between outer tip portions bent upwardly to form retaining hooks 70 and 72.

The basket 14 includes a plurality of parallel U-shaped transverse wires 80 and a plurality of parallel U-shaped longitudinal wires 82, all of which have horizontal segments disposed in a criss-cross pattern and welded together at spaced intervals to define a wire grid basket bottom. The basket 14 further includes a wire rim or hoop 84 that extends across and is welded to all of the outer ends of the U-shaped wires 80 and 82 and fixes all those outer ends in rigid relative positions. All of the opposite arms of the U-shaped wires 80 and 82 taper down to the basket bottom so that the basket 14 has four inclined side walls and hence is nestable with other like baskets.

The hoop and hook assembly 16 has a main wire that includes a middle portion forming a horizontally planar hoop 88, and outer portions bent downwardly to form L-shaped hooks 90 and 92. The hoop and hook assembly 16 gains rigidity from a horizontal brace wire 94 extending across and being welded to the vertical stems of the L-shaped hooks 90 and 92.

Figure 7:
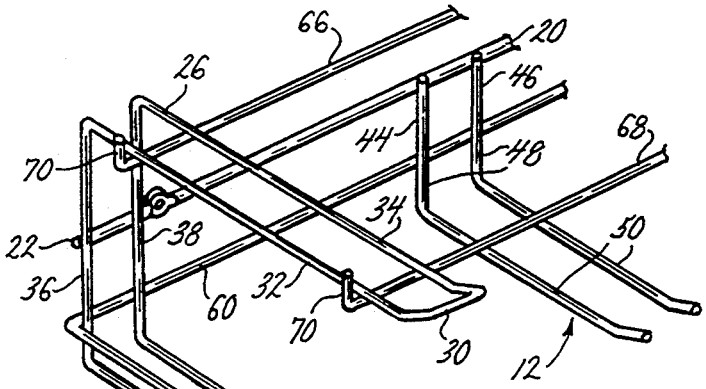
FIG. 7 is a perspective view of the fixed frame of the present invention partly broken away.
Figure 8:
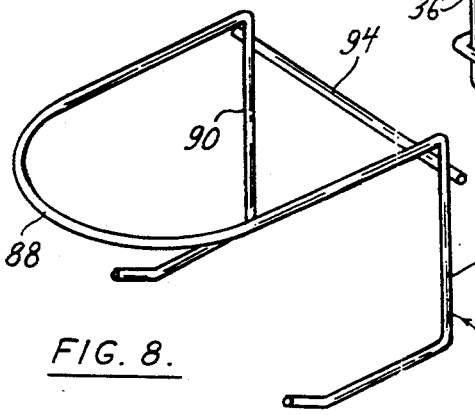
FIG. 8 is a perspective view of the hoop and hook assembly of the present invention.

On the main frame 12, the C-shaped brackets 26 and 28 and the L-shaped brackets 44 and 46 define three sets of bat retainers projecting forwardly from the vertical plane of the mounting wire 20. The left (as viewed in FIGS. 1, 2 and 7) C-shaped bracket 26 has its parallel lower segments 40 and 42 defining a first bat retainer. The horizontal segments 50 of the L-shaped brackets 44 and 46 cooperatively define a second bat retainer. The right C-shaped bracket 28 has its parallel lower segments 40 and 42 defining a third bat retainer. These three sets of bat retainers provide removable and upright support for bats B by providing elongated surface portions for engaging the knobs K of the bat handles as shown in FIG. 1. The bat retainers can optionally support other articles of sports equipment such as a hockey stick H and the like.

The parallel guide members 66 and 68 provide spaced apart elongated surface portions for removably supporting a plurality of balls such as a soccer ball S as well as other similarly sized balls like basketballs or volleyballs. The right upper segment 34 of the left C-shaped bracket 26 and the left upper segment 32 of the right C-shaped bracket 28 act as opposite lateral stops for retaining therebetween balls that are removably supported on the parallel guides 66 and 68.

The basket 14 provides temporary storage for articles such as, among other examples, smaller sized balls like footballs or baseballs. The middle hoop portion 88 of the hoop and hook assembly 16 provides a horizontal partial ring portion for removably supporting a ball like a volleyball V, or other similarly sized larger balls like soccer balls or basketballs. The hooks 90 and 92 of the hoop and hook assembly 16 can support other kinds of sports equipment, including but not limited to boxing gloves G.

The basket 14 and the hoop and hook assembly 16 can be removed for remote use away from the main frame 12. The basket 14 is removably supported on the right lateral side of the main frame 12 by means of the retaining hooks 72 releasably retaining the rim or hoop element 84. At the same time, the forwardly projecting outer portion 64 provides side support for the outer surfaces of the arms of the U-shaped basket wires 80. The hoop and hook assembly 16 is removably supported on the left lateral side of the main frame 12 by means of the retaining hooks 70 releasably retaining the brace wire 94 while at the same time the forwardly projecting outer portion 62 provides side support for the vertical stem of the rearward L-shaped hook segment 90. Supporting the basket 14 on the right lateral side of the main frame 12 and the hoop and hook assembly 16 on the left lateral side has been shown for the sake of an example, because they can be supported on either lateral side of the main frame 12 interchangeably.

While the present invention has been described by reference to a specific embodiment, it should be understood that modifications and variations of the invention may be constructed without departing from the scope of the invention defined in the following claims.

What is claimed is:

1. A wire frame support rack for sports equipment, the rack comprising:

mounting means for mounting on a wall;

a plurality of bat retainers supported by the mounting means and projecting forwardly relative to the wall, each bit retainer providing removable and upright support for a plurality of bats, at least one of said bat retainers having a forwardly projecting horizontal segment that is a lower horizontal segment of a C-shaped member comprised of the lower horizontal segment, a rear vertical segment, and an upper horizontal segment;

a ball support assembly supported by the mounting means; the assembly comprising two spaced guide segments extending laterally relative to the wall, and two ball stops disposed in laterally spaced positions relative to the spaced guide segments;

the two guide segments providing spaced apart elongated surface portions for removably supporting a plurality of balls such as basketballs, soccer balls, volleyballs, and the like; the ball stops retaining such removably supported balls therebetween.

2. The rack of Claim 1 wherein:

each bat retainer comprises two parallel segments, each segment extending generally horizontally between a front section and a rear section anchored to the mounting means, the two segments defining a slot that opens forwardly.

3. The rack of Claim 1 wherein:

each bat retainer includes a forwardly projecting horizontal segment that is a lower horizontal segment of a C-shaped member comprising the lower horizontal segment, a rear vertical segment, and an upper horizontal segment;

the two C-shaped members being supported by the mounting means in laterally spaced positions.

4. The rack of Claim 3 wherein:

the two guide segments are supported in position by the upper segments of the two C-shaped members; and the ball stops are the spaced upper segments.

5. A sports equipment support rack comprising:

a basket having a front, a back and two opposite side walls, and having retaining means secured to at least one of the side walls;

a fixed frame comprising a bat retainer for removably and uprightly supporting a plurality of bats, cooperating means for releasably retaining the basket by the retaining means, and mounting means for attaching to a wall and for securely supporting the bat retainer and the cooperating means;

the basket comprises criss-crossed U-shaped wires;

the retaining means comprises a wire hoop welded to the side walls, and the fixed frame comprises selectively formed wires welded together of which the cooperating means comprises two wire end portions formed as retaining hooks.

6. The rack of claim 5 wherein:

the bat retainer comprises a pair of generally parallel horizontal segments extending between rear sections anchored to the mounting means and front sections, and providing elongated surface portions upon which a plurality of knobs of bat handles can be removably supported.

7. The rack of claim 5 wherein:

the bat retainer is supported in position by the mounting means to project forwardly relative to the wall; and the cooperating means is supported in position on one lateral side of the bat retainer.

8. The rack of claim 7 further comprising:

a second cooperating means supported in position by the mounting means on the lateral side of the bat retainer opposite to the other cooperating means;

wherein the basket can be releasably retained by either cooperating means interchangeably.

9. The rack of claim 8 further comprising:

an elongated element having a middle portion forming a horizontal hoop and outer portions forming opposite L-shaped hooks, and having retaining means secured to the vertical stems of the L-shaped hooks which can be releasably retained by either cooperating means interchangeably;

wherein the hoop provides removable support for a ball such as a basketball, soccer ball, volleyball or the like.

10. A sports equipment support rack comprising:

a basket having a front, a back and two opposite side walls, and having retaining means secured to at least one of the side walls; and a fixed frame comprising:

two spaced guide members, each guide member providing an elongated support surface portion, cooperating means for releasably retaining the basket by the retaining means, mounting means for attaching to a wall and for securely supporting the guide members and the cooperating means;

the two spaced and elongated surface portions providing removable support for a plurality of balls such as basketballs, soccer balls, volleyballs and the like;

the elongated surface portions extend in the lateral direction relative to the wall, and the cooperating means is supported in position on one lateral side of the fixed frame.

11. The rack of claim 10 wherein:

the retaining means comprises a spaced pair of loop portions, and the cooperating means comprises a pair of equally spaced retaining hooks for hooking the loop portions;

the mounting means further comprises means providing side support for at least one of the side walls of the basket.

12. The rack of claim 10 further comprising:

a second cooperating means positioned on the lateral side of the fixed frame opposite to the other cooperating means;

wherein the basket can be releasably retained by either cooperating means interchangeably.

13. The rack of claim 12 further comprising:

an elongated element having a middle portion forming a horizontal hoop and outer portions forming opposite L-shaped hooks, and having retaining means secured to the vertical stems of the L-shaped hooks which can be releasably retained by either cooperating means interchangeably;

wherein the hoop portion provides removable support for a ball such as a basketball, soccer ball, volleyball or the like.

14. The rack of claim 12 wherein:

the fixed frame further comprises a plurality of bat retainers supported by the mounting means below the guide members;

each bat retainer comprises a pair of generally parallel L-shaped segments of wire, the L-shaped segments including generally horizontal segments extending from rear bends to front sections and providing elongated surface portions upon which a plurality of knobs of bat handles can be removably supported.

15. The rack of claim 12 wherein:

at least two bat retainers each includes two forwardly projecting horizontal segments that are lower horizontal segments of two C-shaped members comprising the lower horizontal segments, two rear vertical segments, and two upper horizontal segments;

the bat retainers being supported by the mounting means in laterally spaced positions.

16. The rack of claim 15 wherein:

the two guide members are supported in position by the upper segments of the C-shaped members; and the spaced apart upper segments retain removably supported balls therebetween.

17. The rack of claim 10 wherein:

the basket comprises criss-crossed U-shaped wires, the retaining means comprises a wire hoop welded to the side walls, and the fixed frame comprises selectively formed wires welded together of which the guide members comprise two parallel wire elements with opposite end portions and the retaining means comprise said end portions formed as retaining hooks.

* * * * *